United States Patent [19]

Sanford, Jr. et al.

[11] 3,966,099

[45] June 29, 1976

[54] TWO MEMBER POURING DEVICE HAVING VENT

[75] Inventors: Walter E. Sanford, Jr., Hugo, Minn.; Peter R. R. Rupp, St. Croix Falls, Wis.

[73] Assignee: Aladdin International, Inc., St. Paul, Minn.

[22] Filed: May 1, 1975

[21] Appl. No.: 573,775

[52] U.S. Cl. ..... 222/478; 222/567

[51] Int. Cl.[2] ..... B67D 3/00

[58] Field of Search ..... 215/309; 222/478, 479, 222/567

[56] References Cited

UNITED STATES PATENTS

| | | | |
|---|---|---|---|
| 2,497,134 | 2/1950 | Muenze | 222/479 UX |
| 3,422,998 | 1/1969 | Murray | 222/567 |
| 3,434,636 | 3/1969 | Kachman | 222/567 |
| 3,630,419 | 12/1971 | Pierce | 222/567 X |

FOREIGN PATENTS OR APPLICATIONS

| | | | |
|---|---|---|---|
| 525,487 | 5/1965 | Canada | 222/478 |

*Primary Examiner*—Robert B. Reeves
*Assistant Examiner*—David A. Scherbel

[57] ABSTRACT

A pouring device for dispensing liquid from a bottle is provided comprising a rigid spout member and a flexible resilient sealing member, the spout member including a rigid base portion having a longitudinally extending trough in the outer wall thereof and the flexible sealing member comprising a tubular body tightly overfitting the base portion of the spout member and having a longitudinal vent tube extending along the inside wall thereof and seating within the trough to prevent relative rotational movement between the spout member and the sealing member and cooperating means on the sealing member and the spout member to prevent relative longitudinal movement between these members.

10 Claims, 5 Drawing Figures

TWO MEMBER POURING DEVICE HAVING VENT

This invention relates to a pouring device for dispensing liquid from a bottle. More particularly, this invention relates to a pourer combining pouring and sealing elements in a unique cooperative relationship.

In the dispensing of liquid from a bottle it has been long known to mount on the top of the bottle a pouring device having a pouring spout overlying the mouth of the bottle to more effectively guide liquid as it is dispensed from the bottle upon tilting the bottle. Such pouring devices come in a wide variety of shapes and sizes but essentially each consists of a pouring spout having a passage for dispensing liquid therethrough and a passage for venting air into the bottle therethrough and means for sealingly attaching the pouring spout to a bottle. Commonly, the base of the pouring spout comprises a cylindrical extension which fits within the neck of a bottle and this cylindrical extension is tightly overfitted with a sealing member comprising a cork or similar sheath which enables the device to be inserted into the neck of a bottle to sealingly retain the device in place over the mouth of the bottle during use.

This invention comprises a pouring device having a unique cooperative relationship between the spout member of the device and the sealing member of the device, the spout member and sealing member cooperating with one another to fix the sealing member and the spout member against relative rotation with respect to one another while providing a unique venting arrangement for the pouring device which avoids the necessity for running a vent tube through the spout portion of the pouring device.

In addition, this new construction enables quick, simple, fool-proof assembly of separately formed spout and sealing elements which interlock by interfit in the final fabrication of the device to prevent longitudinal as well as rotational movement of these elements with respect to one another.

The pouring device of this invention comprises the combination of a spout member and sealing member; the spout member comprises a rigid body having an upper spout portion and a lower base portion and having a passage therethrough opening at one end through the bottom of the base portion and at its other end through the top of the spout portion, the base portion being generally cylindrical and having a longitudinal trough or groove in the exterior wall surface thereof. The sealing member comprises a flexible, resilient, tubular body tightly fitting over the base portion of the spout member and having a longitudinally extending tubular air vent attached to the inner wall surface thereof which seats within the trough to prevent relative rotational movement of the spout member and the sealing member relative to one another while providing a versatile venting arrangement which enables venting of the pouring device without necessitating a vent tube extension through the spout portion of the spout member. The unique pouring device comprising this invention and other and further advantages that flow therefrom are more specifically described with respect to a preferred embodiment of the invention set forth in the accompanying drawings wherein:

Figure 2:
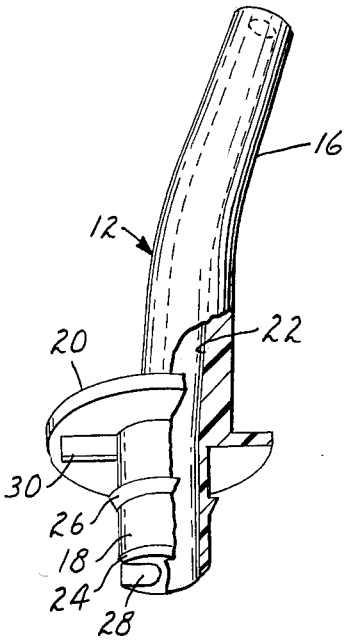
FIG. 2 is a perspective view with certain portions being broken away of the spout member of the pouring device.
Figure 3:
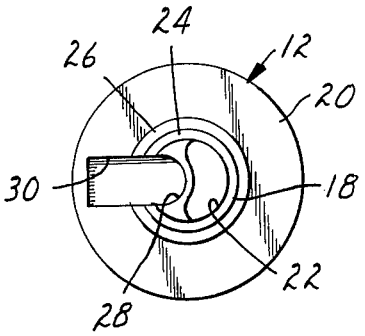
FIG. 3 is a bottom view of the spout member of the pouring device.
Figure 4:
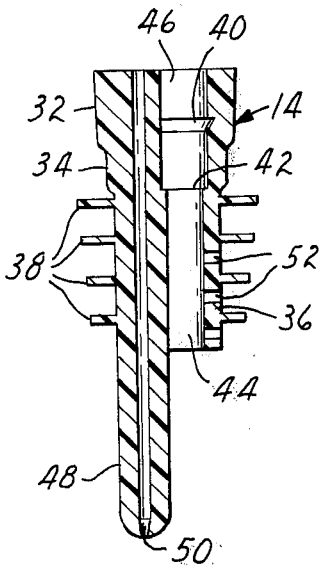
FIG. 4 is a longitudinal sectional view of the sealing member of the pouring device.

Turning first to FIGS. 1 through 4 of the drawings, the pouring device is designated in its entirety by the numeral 10 and is seen to consist of a spout member 12 (FIG. 2) and a sealing member 14 (FIG. 4). Preferably, the spout member 12 is a rigid or hard bodied plastic or the like and the sealing member or element 14 is a flexible material with at least sufficient resilience to return to shape after being subjected to mild stretching or compression forces; as compared to the spout member, it is generally of a softer material.

With particular reference to FIG. 2, the spout member 12 is seen to comprise an upper spout portion 16 and a lower base portion 18 with a circular disc like flange 20 separating the base and spout portions of the spout element from one another. A longitudinal bore or passage 22 extends from the bottom of the base portion through the top of the spout portion to facilitate the passage of liquid from a bottle through the spout member. The bottom outside edge of the outer wall of the base is preferably inwardly beveled as at 24 to facilitate the application of the sealing member 14 thereto.

Intermediate its length the outer wall of the base portion 18 of the spout member 12 is provided with a projection in the form of a circumferentially extending lip 26 which extends part of the way around the base portion. The outer wall of the base portion 18 is also provided with a longitudinally extending trough or groove 28 which extends the length thereof, the lower end thereof being coterminous with the bottom of the base portion and the upper end thereof opening into a groove projecting radially outward from the central portion toward the periphery of the undersurface of the flange 20. In the embodiment shown the groove 30 terminates short of the peripheral edge of the flange 20 so that the groove opens only downwardly and does not interrupt the continuous peripheral edge of the flange 20; this is advantageous esthetically and for ease of cleaning.

As is most clearly depicted in FIG. 3, the spout passage 22 has no communication with the trough 28 in the base portion 18 of the spout member, being radially offset therefrom, a constructional feature which is provided to interlock the spout and sealing members against relative rotational movement as well as facilitate side venting of the pouring device (rather than having a vent tube extension going up through the spout portion 16 along side the pouring passage 22). This construction also gives much greater flexibility in the pouring spout design than would be possible with a vent tube arrangement going through the spout itself.

Figure 5:
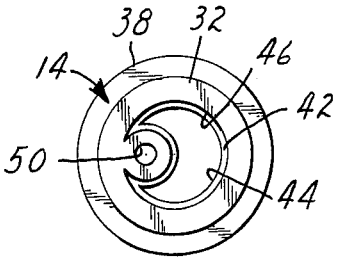
FIG. 5 is a top view of the sealing member.

The sealing element 14 is best illustrated in FIGS. 4 and 5 wherein it is seen to consist of a generally cylindrical tubular body of a stepped construction having a thicker top section 32, a somewhat thinner intermediate section 34 and a yet thinner lower portion 36. This stepped construction provides a wedging action in the neck of a bottle which appears to be more resistant to inadvertent dislodgment than are conventional frustoconically shaped sealing elements. The lower portion 36 is provided with longitudinally spaced radially outward projecting circular sealing fins 38 of varying diameters, the smallest diameter fin being the lowermost with each remaining fin thereabove being slightly larger than the one below it. This enables the sealing element to fit within bottle necks having widely differing diameters.

The top section 32 of the sealing member 14 is provided with a recess 40 in the inner wall surface thereof which is shown in the form of a circumferentially extending groove. The inside wall surface of the thickened upper section 32 and the intermediate section 34, except for the groove 40 of course, is generally of a diameter to tightly overfit the outer wall of the base 18 of the spout member 12 as illustrated particularly in FIG. 1. When pressed over this base 18, the sealing member is fixed against longitudinal movement by the seating of the projection 26 in the recess 40, the body of the sealing member 14 being sufficiently resilient to stretch over the lip 26 until the lip seats within the recess 40 and then return to tightly overfit the portion of the base 18 above the lip 26. By outwardly beveling the lip 26 from the lower portion thereof to the upper portion thereof to form an outwardly extending beveled shoulder and by correspondingly forming the groove or recess 40 to receive the lip 26, the sealing member 14 once slipped into place over the base 18 is permanently affixed thereto and longitudinal movement of these two elements with respect to one another is no longer possible. This is advantageous when removing the pouring device 10 from the neck of a bottle.

The tubular passage or bore through the lower section 36 of the sealing member 14 is slightly smaller in diameter than the upper portion of this bore or passage and an internal shoulder 42 is formed at the juncture of the lower portion 44 of this passage with the upper portion 46 of this passage. Upon pressing the sealing member and pouring member together in assembling the device 10, the bottom of the pouring member abuts the shoulder 42 to prevent further insertion of the puring member into the tubular passage of the sealing member.

Attached along the inside wall of the bore formed by the upper and lower passages 44 and 46 of the sealing member 14 is a longitudinally extending vent tube 48 with the venting passage or bore 50 extending the length thereof. As shown, the top of the vent tube 48 terminates commensurate with the top of the sealing member 14 whereas the lower portion thereof extends quite a way below the main body of the sealing member 14. The extension below the body is, of course, an aid to the venting operation during pouring of liquid from a bottle whose mouth is covered by the pouring device.

Figure 1:
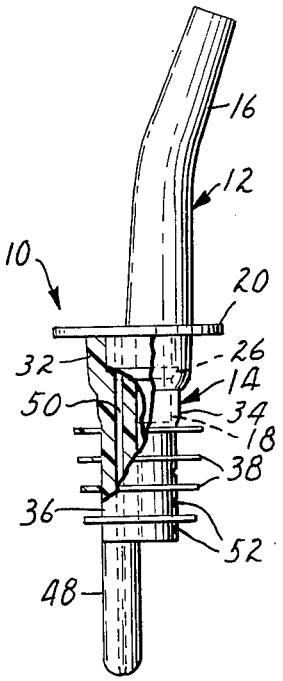
FIG. 1 is a side elevational view of the pouring device of the invention.

In assembling the device to the form shown in FIG. 1, the sealing member 14 is simply pressed over the base portion 18 of the spout member 12, the beveled lower edge 24 of the base portion facilitating this operation by wedgingly stretching the sealing member as the base portion is pressed home into the upper portion 46 of the tubular bore through the sealing member. As the members 12 and 14 are pressed together, the vent tube 48 slides up the trough 28 and opens at its upper end into the groove 30 on the undersurface of the flange 20. Not only does this provide a unique efficient side venting arrangement but it orients the assembly of the spout member and the sealing member 14 to one another while preventing relative rotation of these members with one another.

In use the device is simply pressed into the mouth of a bottle. The fins 38 sealingly engage the side walls of the bottle neck and the flange 20 overlies the mouth of the bottle. If desired, one or more weep holes 52 (FIG. 1) may be provided in the lower section 36 of the sealing element between fins.

That which is claimed is:

1. A pourer for guiding the flow of liquid from a bottle comprising a spout member and a sealing member, said spout member comprising a rigid body having an upper spout portion and a lower base portion and having a passage therethrough opening at one end through the bottom of said base portion and at its other end through the top of said spout portion, said base portion being generally cylindrical and having a longitudinal trough in the exterior wall surface thereof, said sealing member comprising a flexible tubular body tightly fitted over said base portion, said sealing member having a longitudinally extending tubular air vent attached as an integral part of the inner wall surface thereof and seating in said trough to prevent relative rotational movement of said spout member and said sealing member relative to one another.

2. A pourer in accordance with claim 1 wherein said base portion of said spout member and said sealing member have cooperating means interlocking them against longitudinal movement relaitve to one another.

3. A pourer in accordance with claim 1 wherein the passage through said spout portion and the trough of said base portion of said spout are separated from and do not communicate with one another.

4. The pourer of claim 3 including a circular flange separating said base portion and said spout portion from one another and closing the upper end of said trough.

5. The pourer of claim 4 wherein said flange has a groove in the undersurface thereon in communication with said trough and said vent tube for venting air radially outwardly therefrom.

6. A pourer for dispensing liquid from a narrow necked bottle, said pourer comprising a rigid spout member for guiding the flow of liquid from the bottle and a flexible resilient sealing member for sealingly seating within the neck of the bottle and removably attaching the pourer thereto, said spout member including a rigid base portion having a longitudinal bore therethrough and having a longitudinally extending trough in the outer wall thereof, said flexible sealing member comprising a tubular body tightly fitting over said rigid base portion and having a longitudinal vent tube provided as an integral part extending along the inside wall thereof and seating within said trough.

7. The pourer of claim 6 wherein said spout member includes a circular flange surrounding the upper end of said base portion for overlying the top of a bottle, said flange having a radially outwardly extending groove in the undersurface thereof into which the upper end of said trough opens.

8. The pourer of claim 6 wherein said sealing member has a recess on the inside wall surface thereof and said base portion of said spout member has a projection on the outer wall surface thereof seating in said recess thereby preventing longitudinal movement of said spout member and said sealing member relative to one another.

9. The pourer of claim 8 wherein said recess is a circumferentially extending groove and said projection is a circumferentially extending lip.

10. A pouring device comprising a spout member for guiding the flow of liquid from the mouth of a bottle and a sealing member for mounting the device in the neck of a bottle, said spout member comprising a rigid body having an upper spout portion and a lower base portion and having a passage therethough opening at one end through the bottom of said base portion and at its other end through the top of said spout portion, said base portion being generally cylindrical and having a longitudinal trough in the exterior wall surface thereof, said sealing member comprising a flexible resilient tubular body tightly fitted over said base portion and having a longitudinally extending tubular air vent attached to the inner wall surface thereof and projecting therebelow, said tubular air vent seating in said trough and fixing said members against rotational movement relative to one another, said spout member including a circular radially extending flange surrounding the upper end of said base portion for overlying the top of a bottle, said flange having a radially outwardly extending groove in the undersurface thereof into which the upper end of said vent tube opens, said sealing member further having a circumferentially extending groove on the inside wall surface thereof, said base portion having a circumferentially extending lip on the outside wall surface thereof seating in said sealing member groove thereby fixing said members against longitudinal movement relative to one another.

* * * * *